US012274290B2

(12) United States Patent
Papakyrillou

(10) Patent No.: US 12,274,290 B2
(45) Date of Patent: Apr. 15, 2025

(54) AEROSOL-GENERATING ARTICLE HAVING A RECESSED SUPPORTING COMPONENT

(71) Applicant: Philip Morris Products S.A., Neuchatel (CH)

(72) Inventor: Stefanos Papakyrillou, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 705 days.

(21) Appl. No.: 17/600,777

(22) PCT Filed: Mar. 12, 2020

(86) PCT No.: PCT/EP2020/056732
§ 371 (c)(1),
(2) Date: Oct. 1, 2021

(87) PCT Pub. No.: WO2020/200693
PCT Pub. Date: Oct. 8, 2020

(65) Prior Publication Data

US 2022/0192253 A1 Jun. 23, 2022

(30) Foreign Application Priority Data

Apr. 4, 2019 (EP) ..... 19167446

(51) Int. Cl.
*A24D 1/20* (2020.01)
*A24F 40/20* (2020.01)
*A24F 40/46* (2020.01)

(52) U.S. Cl.
CPC ..... *A24D 1/20* (2020.01); *A24F 40/20* (2020.01); *A24F 40/46* (2020.01)

(58) Field of Classification Search
CPC ..... A24D 1/20; A24F 40/20; A24F 40/46
See application file for complete search history.

(56) References Cited

U.S. PATENT DOCUMENTS 3,396,733 A 8/1968 Allseits et al.
2016/0331032 A1 11/2016 Malgat et al.
(Continued)

FOREIGN PATENT DOCUMENTS

CN 107536115 A 1/2018
CN 107690288 A 2/2018
(Continued)

OTHER PUBLICATIONS

English Translation of JP 2016538848 (Year: 2016).*
(Continued)

*Primary Examiner* — Manley L Cummins, IV
(74) *Attorney, Agent, or Firm* — Oblon, McClelland, Maier & Neustadt, L.L.P.

(57) ABSTRACT

An aerosol-generating article for producing an inhalable aerosol upon heating is provided, including: a rod of aerosol-generating substrate; a mouthpiece segment including a plug; a tubular support element between the rod and the segment and being in longitudinal alignment therewith, arranged immediately downstream of the rod, defining an airflow conduit, and including a cylindrical peripheral wall, a portion of the element projecting inwardly and delimited at an upstream end by a surface spaced from a transverse plane tangent to an upstream end surface of the wall; and a recess defined by the element and being between a downstream end surface of the rod and an upstream end surface of the element, extending longitudinally from a downstream end of the recess to the segment, being less than 10 percent of a length of the article, and a cross-sectional area of the recess changing along a length of the recess.

14 Claims, 2 Drawing Sheets

(56) References Cited

U.S. PATENT DOCUMENTS

| | | | | |
|---|---|---|---|---|
| 2020/0205468 | A1* | 7/2020 | Nappi | A24D 1/20 |
| 2022/0015414 | A1* | 1/2022 | Uthurry | A24D 1/027 |
| 2022/0030935 | A1* | 2/2022 | Uthurry | A24D 1/20 |

FOREIGN PATENT DOCUMENTS

| | | | | | |
|---|---|---|---|---|---|
| CN | 108113051 | A | | 6/2018 | |
| CN | 108601407 | A | | 9/2018 | |
| EP | 0 822 760 | B1 | * | 2/1998 | A24F 40/46 |
| EP | 3 494 809 | B1 | * | 2/2021 | A24D 1/20 |
| GB | 2 082 042 | A | | 3/1982 | |
| GB | 2534208 | A | * | 7/2016 | A24D 1/004 |
| JP | 59-154977 | A | | 9/1984 | |
| JP | 60-137273 | A | | 7/1985 | |
| JP | 2015-518730 | A | | 7/2015 | |
| JP | 2016-538848 | A | | 12/2016 | |
| JP | 2017-519493 | A | | 7/2017 | |
| JP | 2022-535394 | A | | 8/2022 | |
| KR | 10-2018-0070516 | A | | 6/2018 | |
| RU | 2 609 395 | C2 | | 2/2017 | |
| WO | WO 96/32854 | A2 | | 10/1996 | |
| WO | WO 2008/015441 | A1 | | 2/2008 | |
| WO | WO 2011/101164 | A1 | | 8/2011 | |
| WO | WO 2012/164009 | A2 | | 12/2012 | |
| WO | WO 2015/007400 | A1 | | 1/2015 | |
| WO | WO 2015/082649 | A1 | | 6/2015 | |
| WO | WO 2015/082652 | A1 | | 6/2015 | |
| WO | WO 2016/023965 | A1 | | 2/2016 | |
| WO | WO 2016/124740 | A1 | | 8/2016 | |
| WO | WO 2019/030274 | A1 | | 2/2019 | |
| WO | WO 2019/030276 | A1 | | 2/2019 | |
| WO | WO 2019/063737 | A1 | | 4/2019 | |
| WO | WO 2020/128043 | A1 | | 6/2020 | |

OTHER PUBLICATIONS

Russian Office Action issued May 25, 2023 in Russian Application 2021128435, (with English Translation), 8 pages.

Russian Search Report issued May 25, 2023 in Russian Application 2021128435, (with English Translation), 4 pages.

Combined Chinese Notice of Allowance and Search Report issued on Sep. 27, 2023 in Chinese Patent Application No. 202080020147.0 (with English translation), 7 pages.

International Search Report and Written Opinion issued on May 29, 2020 in PCT/EP2020/056732 filed on Mar. 12, 2020.

Japanese Decision to Grant issued May 13, 2024 in Japanese Patent Application No. 2021-556636, 2 pages.

* cited by examiner

A-A

B-B

C-C

AEROSOL-GENERATING ARTICLE HAVING A RECESSED SUPPORTING COMPONENT

The present invention relates to an aerosol generating article comprising an aerosol-generating substrate and adapted to produce an inhalable aerosol upon heating.

Aerosol-generating articles in which an aerosol-generating substrate, such as a tobacco-containing substrate, is heated rather than combusted, are known in the art. Typically in such heated smoking articles, an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

Substrates for heated aerosol-generating articles have, in the past, typically been produced using randomly oriented shreds, strands, or strips of tobacco material. More recently, alternative substrates for aerosol-generating articles to be heated rather than combusted have been disclosed, such as rods formed from gathered sheets of tobacco material. By way of example, the rods disclosed in international patent application WO-A-2012/164009 have a longitudinal porosity that allows air to be drawn through the rods. As a further alternative, international patent application WO-A-2011/101164 discloses rods for heated aerosol-generating articles formed from strands of homogenised tobacco material, which may be formed by casting, rolling, calendering or extruding a mixture comprising particulate tobacco and at least one aerosol former to form a sheet of homogenised tobacco material. In another embodiment, the rods of WO-A-2011/101164 may be formed from strands of homogenised tobacco material obtained by extruding a mixture comprising particulate tobacco and at least one aerosol former to form continuous lengths of homogenised tobacco material.

Substrates for heated aerosol-generating articles typically further comprise an aerosol former, that is, a compound or mixture of compounds that, in use, facilitates formation of the aerosol and that preferably is substantially resistant to thermal degradation at the operating temperature of the aerosol-generating article. Examples of suitable aerosol-formers include: polyhydric alcohols, such as propylene glycol, triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

It is also common to include in an aerosol-generating article for producing an inhalable aerosol upon heating one or more additional elements that are assembled with the substrate in a same wrapper. Examples of such additional elements include a mouthpiece filtration segment, a support element adapted to impart structural strength to the aerosol-generating article, a cooling element adapted to favour cooling of the aerosol prior to reaching the mouthpiece, and so forth. However, although such additional elements may have several advantageous effects, their inclusion in an aerosol-generating article generally complicates the overall structure of the article and makes its manufactures more complex and less cost-effective.

In view of this, aerosol-generating articles have been proposed that have a simpler structure. However, in the absence of certain additional components it may become more difficult to manufacture aerosol-generating articles that consistently provide the consumer with a satisfactory RTD. Further, it may become more difficult to manufacture aerosol-generating articles that consistently provide a satisfactory aerosol delivery to the consumer. By way of example, in the absence of an element especially adapted for cooling the gaseous stream flowing along the article during use, it may become more difficult to lower the temperature of the vapour phase generated upon heating and to attain condensation of aerosol particles. This may limit the amount of aerosol particles that manage to condense and be effectively delivered to the consumer.

Thus, it would be desirable to provide an aerosol generating article that can be more easily manufactured efficiently and at high speed, whilst at the same time enabling the provision of a consistently satisfactory aerosol delivery to the consumer during use.

The present invention relates to an aerosol-generating article for producing an inhalable aerosol when heated. The aerosol generating article may comprise a rod of aerosol-generating substrate. Further, the aerosol generating article may comprise a mouthpiece segment comprising a plug of filtration material. The aerosol-generating article may comprise a tubular support element at a location between the rod and the mouthpiece segment, wherein the tubular support element is in longitudinal alignment with the rod and the mouthpiece segment, is arranged immediately downstream of the rod, and defines at least one airflow conduit establishing fluid communication between the rod and the mouthpiece segment. The tubular support element may comprise a cylindrical peripheral wall and extend from an outer surface of the cylindrical peripheral wall towards a longitudinal axis of the tubular support element. The aerosol-generating article may comprise a recess defined by the tubular support element. The recess may be comprised between a downstream end surface of the rod and an upstream end surface of the tubular support element. The recess may have a length of less than about 10 percent of an overall length of the aerosol-generating article. The at least one airflow conduit may extend longitudinally from a downstream end of the recess to the mouthpiece segment.

According to an aspect of the present invention, there is provided an aerosol-generating article for producing an inhalable aerosol when heated, the aerosol-generating article comprising: a rod of aerosol-generating substrate; a mouthpiece segment comprising a plug of filtration material; and a tubular support element at a location between the rod and the mouthpiece segment. The tubular support element is in longitudinal alignment with the rod and the mouthpiece segment, is arranged immediately downstream of the rod, and defines at least one airflow conduit establishing fluid communication between the rod and the mouthpiece segment. Further, the tubular support element comprises a cylindrical peripheral wall and extends radially from an outer surface of the cylindrical peripheral wall towards a longitudinal axis of the tubular support element. In addition, the aerosol-generating article comprises a recess defined by the tubular support element, the recess being comprised between a downstream end surface of the rod and an upstream end surface of the tubular support element. The recess has a length of less than about 10 percent of an overall length of the aerosol-generating article. The at least one airflow conduit extends longitudinally from a downstream end of the recess to the mouthpiece segment.

According to another aspect of the present invention, there is provided an aerosol-generating system comprising an aerosol generating article as described above and an electrically operated aerosol generating device comprising a heating element and an elongate heating chamber configured to receive the aerosol generating article so that the rod of aerosol-generating substrate is heated in the heating chamber.

It will be appreciated that any features described with reference to one aspect of the present invention are equally applicable to any other aspect of the invention.

The term "aerosol generating article" is used herein to denote an article wherein an aerosol generating substrate is heated to produce and deliver an aerosol to a consumer. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention find particular application in aerosol generating systems comprising an electrically heated aerosol generating device having an internal heater blade which is adapted to be inserted into the rod of aerosol generating substrate. Aerosol generating articles of this type are described in the prior art, for example, in EP 0822760.

As used herein, the term "aerosol generating device" refers to a device comprising a heater element that interacts with the aerosol generating substrate of the aerosol generating article to generate an aerosol.

During use, volatile compounds are released from the aerosol-generating substrate by heat transfer and entrained in air drawn through the aerosol generating article. As the released compounds cool they condense to form an aerosol that is inhaled by the consumer.

As used herein, the term "tubular element" denotes an elongate element defining a lumen or airflow passage along a longitudinal axis thereof. In the context of the present specification, the term "tubular" is intended to encompass any tubular element having a substantially cylindrical cross-section which defines at least one airflow conduit establishing fluid communication between an upstream end of the tubular element and a downstream end of the tubular element.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use. During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "recess" is used herein to denote a hollow space within the aerosol-generating article. A recess is "defined" by a component of the aerosol-generating article if said hollow space is substantially enclosed by the component.

In practice, a recess is defined by a component of the aerosol-generating article if the boundaries of the hollow space are partly set by one or more end surfaces of the component. This means that the volume of the recess is not occupied by any of the material of which the tubular support element is made and is substantially empty.

One such recess defined by a component of the aerosol-generating article is open on the side facing away from the one or more end surfaces of the component. Thus, a boundary of the recess on the side facing away from the one or more end surfaces of the component may be considered to be effectively defined by an end surface of another component of the aerosol-generating article adjacent the component defining the recess.

As described briefly above, in aerosol-generating articles in accordance with the invention, the tubular support element is arranged immediately downstream of the rod. In the context of the present invention, the expression "immediately downstream of the rod" means that the tubular support element and the rod are in contact with one another or very close to one another, such that when the article is received for use in an aerosol-generating device adapted to heat the aerosol-generating substrate (e.g., one including a heating element that is inserted into the substrate) the tubular support element effectively provides support for the rod, with little to no deformation of the aerosol-generating article, or with little to no displacement of the rod, or both. Thus, in practice, in the context of the present invention, the expression "immediately downstream of the rod" is used to indicate that a minimum longitudinal distance between a downstream end surface of the rod and an upstream end surface of the tubular support element—such as, for example, an upstream end surface of the peripheral wall of the tubular support element—is less than 1 millimetre, preferably less than 0.5 millimetres, even more preferably less than 0.25 millimetres. In particularly preferred embodiments, the rod of aerosol-generating substrate and the tubular support element are in contact.

As will be described in more detail below, in the context of the present invention the tubular support element is conformed such that, when an upstream end surface of the peripheral wall contacts the downstream end surface of the rod of aerosol-generating substrate, at least another upstream end surface of the tubular support is spaced from the downstream end surface of the rod. Thus, a downstream boundary of the recess is defined by said at least another upstream end surface of the hollow tube segment. At the same time, an upstream boundary of the recess is considered to be set by a plane transverse to the longitudinal direction and coplanar with the upstream end surface of the peripheral wall of the tubular support element. In practice, as the tubular support element is aligned with, and in abutting end-to-end arrangement with the rod, the boundary of the recess on the side facing away from the at least another upstream end surface of the tubular support element may be considered to substantially coincide with the downstream end surface of the rod.

The term "length" denotes the maximum dimension of a component of the aerosol-generating article in the longitudinal direction. For example, it may be used to denote the dimension of the rod or of the tubular element in the longitudinal direction. In particular, in the context of the present invention, the term "length of the recess" is used to denote the maximum distance between the upstream and downstream boundaries of the recess. In practice, this is assessed as the maximum distance between the plane defined by the upstream end surface of the peripheral wall of the tubular support element (or the plane defined by the downstream end of the rod of aerosol-generating substrate) and the downstream boundary of the recess defined by said at least another upstream end surface of the tubular support element.

The term "thickness of a wall of the tubular element" is used in the present specification to denote the minimum distance measured between the outer surface and the inner surface of a wall of a tubular element. In practice, the distance at a given location is measured along a direction locally substantially perpendicular to opposite sides of the wall of the tubular element. For a substantially cylindrical tubular element, that is, a tubular element having a substantially circular cross-section, the thickness of the peripheral wall is assessed as the distance between the outer surface and the inner surface of the peripheral wall measured along a substantially radial direction of the tubular element. In those embodiments where the tubular element comprises one or more internal transverse walls extending from a point on the inner surface of the peripheral wall to another point on the inner surface of the peripheral wall, the thickness of the internal wall is assessed as the distance between opposite sides of the internal wall measured along a direction perpendicular to both sides of the internal wall.

The expression "air-impervious material" is used throughout this specification to mean a material not allowing the passage of fluids, particularly air and smoke, through interstices or pores in the material. If the support element is formed of a material impervious to air and aerosol particles, air and aerosol particles drawn through the support element are forced to flow through the airflow conduit, but cannot flow across a wall of the support element.

The term "exposed surface area of the hollow tubular segment" is used herein to denote the cumulative surface area of the various surfaces of the hollow tubular segment that, during use, are exposed to the aerosol flowing through the aerosol-generating article. Thus, the exposed surface area of the hollow tubular segment includes the surface area of the inner surface of the cylindrical peripheral wall of the hollow tubular support element. Further, as will be explained in more detailed in the following description and in the Examples, the exposed surface area of the hollow tubular segment includes the surface area of both sides of any internal transverse wall of the hollow tubular support element extending from a point on the inner surface of the peripheral wall to another point on the inner surface of the peripheral wall.

As used in the present specification, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise a minor quantity of one or more of tobacco dust, tobacco fines, and other particulate tobacco by-products formed during the treating, handling and shipping of tobacco. The sheets of homogenised tobacco material may be produced by casting, extrusion, paper making processes or other any other suitable processes known in the art.

The term "porous" is used herein to refer to a material that provides a plurality of pores or openings that allow the passage of air through the material.

As briefly described above, the aerosol generating article of the present invention incorporates a rod of aerosol-generating substrate, a mouthpiece segment comprising a plug of filtration material, and a tubular support element between the rod and the mouthpiece segment. The tubular support element is in longitudinal alignment with the rod and the mouthpiece segment, is arranged immediately downstream of the rod, and defines at least one airflow conduit establishing fluid communication between the rod and the mouthpiece segment.

In more detail, the hollow tubular support element comprises a cylindrical peripheral wall and extends inwards from an outer surface of the cylindrical peripheral wall towards a longitudinal axis of the hollow tubular support element.

In contrast to existing aerosol-generating articles, the aerosol-generating article comprises a recess defined by the tubular support element, wherein the recess is comprised between a downstream end surface of the rod and an upstream end surface of the tubular support element. The recess has a length of less than about 10 percent of an overall length of the aerosol-generating article. The at least one airflow conduit extends longitudinally from a downstream end of the recess to the mouthpiece segment.

Air and aerosol particles drawn through the support element during use will preferably flow along the at least one airflow conduit. As it is easy to provide one such airflow conduit that has a well-defined location within the aerosol-generating article and a predetermined cross-section, by adjusting the number and geometry of the airflow conduits it is advantageously easy to control the contribution that the tubular support element makes to the overall RTD of the aerosol-generating article. Without wishing to be bound by theory, it is expected that the tubular support element of aerosol-generating articles in accordance with the invention substantially will not contribute to the overall RTD of the aerosol-generating article. In effect, the overall RTD of the aerosol-generating article is expected to depend largely on the RTD of the rod of aerosol-generating substrate and the RTD of the mouthpiece segment. In addition, this is expected to make it easier to manufacture aerosol-generating articles with particularly consistent RTD values.

Further, by providing a recess immediately downstream of the rod of aerosol-generating article, in aerosol-generating articles in accordance with the invention it is easier to ensure that damages to the support element which may be caused, during use, by exposure of the upstream end surfaces of the support element to particularly high temperatures, are prevented. This also helps preserve the geometry and arrangement of the airflow conduit or conduits such that the aerosol can continue to flow through the article and towards the mouthpiece, and that the RTD of the article does not change, during use. Without wishing to be bound by theory, it is understood that, when existing aerosol-generating articles are used in devices comprising a heating element in the form of a blade heater or pin heater that is inserted into the rod, temperature profiles in the aerosol-generating article present maxima at locations within the rod or in the vicinity of the rod or both. The provision of a recess at the downstream end of the rod may help reduce the likelihood that the tip of the heating element inadvertently touches the support element, for example in case the heating element is pushed too deep into the rod. Further, in contrast to existing aerosol-generating articles, a volume is provided for the air and vaporised species to flow through immediately downstream of the rod, wherein some cooling may occur prior to the gaseous flow reaching the airflow conduit or conduits.

In addition, when existing aerosol-generating articles are used in devices comprising a heating element in the form of a blade heater or pin heater that is inserted into the rod, some of the substrate may become displaced and even pushed out at the downstream end of the rod. In particular, where the rod comprises cast leaf particles or a gathered homogenised tobacco material as the substrate, insertion of a blade heater or pin heater into the rod may cause some of the material at the core of the rod to be pushed out. In turn, this may undesirably cause a blockage of the airflow pathway in existing aerosol-generating articles. By contrast, in aerosol-generating articles in accordance with the invention, the recess at the upstream end of the tubular support element may advantageously prevent one such blockage.

Aerosol-generating articles in accordance with the invention can be made in a continuous process which can be efficiently carried out at high speed, and can be conveniently manufactured on existing production lines for the manufactured of heated aerosol generating articles without requiring extensive modifications of the manufacturing equipment.

Aerosol generating articles in accordance with the present invention comprise an aerosol generating substrate, which may be provided in the form of a rod circumscribed by a wrapper.

The rod of aerosol generating substrate preferably has an external diameter that is approximately equal to the external diameter of the aerosol generating article.

Preferably, the rod of aerosol generating substrate has an external diameter of at least 5 millimetres. The rod of aerosol generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol generating substrate has an external diameter of 7.2 millimetres, to within 10 percent.

The rod of aerosol generating substrate may have a length of between about 5 millimetres and about 100 mm. Preferably, the rod of aerosol generating substrate has a length of at least about 5 millimetres, more preferably at least about 7 millimetres. In addition, or as an alternative, the rod of aerosol generating substrate preferably has a length of less than about 80 millimetres, more preferably less than about 65 millimetres, even more preferably less than about 50 millimetres. In particularly preferred embodiments, the rod of aerosol generating substrate has a length of less than about 35 millimetres, more preferably less than 25 millimetres, even more preferably less than about 20 millimetres. In one embodiment, the rod of aerosol generating substrate may have a length of about 10 millimetres. In a preferred embodiment, the rod of aerosol generating substrate has a length of about 12 millimetres.

Preferably, the rod of aerosol generating substrate has a substantially uniform cross-section along the length of the rod. Particularly preferably, the rod of aerosol generating substrate has a substantially circular cross-section.

In preferred embodiments, the aerosol-generating substrate comprises one or more gathered sheets of homogenised tobacco material. Preferably the one or more sheets of homogenised tobacco material are textured. As used herein, the term 'textured sheet' denotes a sheet that has been crimped, embossed, debossed, perforated or otherwise deformed. Textured sheets of homogenised tobacco material for use in the invention may comprise a plurality of spaced-apart indentations, protrusions, perforations or a combination thereof. According to a particularly preferred embodiment of the invention, the rod of aerosol-generating substrate comprises a gathered crimped sheet of homogenised tobacco material circumscribed by a wrapper.

As used herein, the term 'crimped sheet' is intended to be synonymous with the term 'creped sheet' and denotes a sheet having a plurality of substantially parallel ridges or corrugations. Preferably, the crimped sheet of homogenised tobacco material has a plurality of ridges or corrugations substantially parallel to the cylindrical axis of the rod according to the invention. This advantageously facilitates gathering of the crimped sheet of homogenised tobacco material to form the rod. However, it will be appreciated that crimped sheets of homogenised tobacco material for use in the invention may alternatively or in addition have a plurality of substantially parallel ridges or corrugations disposed at an acute or obtuse angle to the cylindrical axis of the rod. In certain embodiments, sheets of homogenised tobacco material for use in the rod of the article of the invention may be substantially evenly textured over substantially their entire surface. For example, crimped sheets of homogenised tobacco material for use in the manufacture of a rod for use in an aerosol-generating article in accordance with the invention may comprise a plurality of substantially parallel ridges or corrugations that are substantially evenly spaced-apart across the width of the sheet.

Sheets or webs of homogenised tobacco material for use in the invention may have a tobacco content of at least about 40 percent by weight on a dry weight basis, more preferably of at least about 60 percent by weight on a dry weight basis, more preferably or at least about 70 percent by weight on a dry basis and most preferably at least about 90 percent by weight on a dry weight basis.

Sheets or webs of homogenised tobacco material for use in the aerosol-generating substrate may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-generating substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets or webs of homogenised tobacco material for use in the aerosol-generating substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets or webs of homogenised tobacco material for use in the aerosol-generating substrate are known in the art and include, but are not limited to: cellulose fibres; soft-wood fibres; hard-wood fibres; jute fibres and combinations thereof. Prior to inclusion in sheets of homogenised tobacco material for use in the aerosol-generating substrate, non-tobacco fibres may be treated by suitable processes known in the art including, but not limited to: mechanical pulping; refining; chemical pulping; bleaching; sulphate pulping; and combinations thereof.

Preferably, the sheets or webs of homogenised tobacco material comprise an aerosol former. As used herein, the term "aerosol former" describes any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

The sheets or webs of homogenised tobacco material may comprise a single aerosol former. Alternatively, the sheets or webs of homogenised tobacco material may comprise a combination of two or more aerosol formers.

The sheets or webs of homogenised tobacco material have an aerosol former content of greater than 10 percent on a dry weight basis. Preferably, the sheets or webs of homogenised tobacco material have an aerosol former content of greater than 12 percent on a dry weight basis. More preferably, the sheets or webs of homogenised tobacco material have an aerosol former content of greater than 14 percent on a dry weight basis. Even more preferably the sheets or webs of homogenised tobacco material have an aerosol former content of greater than 16 percent on a dry weight basis.

The sheets of homogenised tobacco material may have an aerosol former content of between approximately 10 percent and approximately 30 percent on a dry weight basis. Preferably, the sheets or webs of homogenised tobacco material have an aerosol former content of less than 25 percent on a dry weight basis.

In a preferred embodiment, the sheets of homogenised tobacco material have an aerosol former content of approximately 20 percent on a dry weight basis.

Sheets or webs of homogenised tobacco for use in the aerosol-generating article of the present invention may be made by methods known in the art, for example the methods disclosed in International patent application WO-A-2012/164009 A2. In a preferred embodiment, sheets of homogenised tobacco material for use in the aerosol-generating article are formed from a slurry comprising particulate tobacco, guar gum, cellulose fibres and glycerine by a casting process.

Alternative arrangements of homogenised tobacco material in a rod for use in an aerosol-generating article will be known to the skilled person and may include a plurality of stacked sheets of homogenised tobacco material, a plurality of elongate tubular elements formed by winding strips of homogenised tobacco material about their longitudinal axes, etc.

As a further alternative, the rod of aerosol-generating substrate may comprise a non-tobacco-based, nicotine-bearing material, such as a sheet of sorbent non-tobacco material loaded with nicotine (for example, in the form of a nicotine salt) and an aerosol-former. Examples of such rods are described in the international application WO 2015/082652. In addition, or as an alternative, the rod of aerosol-generating substrate may comprise a non-tobacco plant material, such as an aromatic non-tobacco plant material.

In the rod of aerosol-generating substrate of articles in accordance with the invention, the aerosol-generating substrate is preferably circumscribed by a wrapper. The wrapper may be formed of a porous or non-porous sheet material. The wrapper may be formed of any suitable material or combination of materials. Preferably, the wrapper is a paper wrapper.

The mouthpiece segment comprises a plug of filtration material capable of removing particulate components, gaseous components or a combination. Suitable filtration materials are known in the art and include, but are not limited to: fibrous filtration materials such as, for example, cellulose acetate tow, viscose fibres, polyhydroxyalkanoates (PHA) fibres, polylactic acid (PLA) fibres and paper; adsorbents such as, for example, activated alumina, zeolites, molecular sieves and silica gel; and combinations thereof. In addition, the plug of filtration material may further comprise one or more aerosol-modifying agent. Suitable aerosol-modifying agents are known in the art and include, but are not limited to, flavourants such as, for example, menthol. In some embodiments, the mouthpiece may further comprise a mouth end recess downstream of the plug of filtration material. By way of example, the mouthpiece may comprise a hollow tube arranged in longitudinal alignment with, and immediately downstream of the plug of filtration material, the hollow tube forming a cavity at the mouth end that is open to the outer environment at the downstream end of the mouthpiece and of the aerosol-generating article.

A length of the mouthpiece is preferably at least about 4 millimetres, more preferably at least about 6 millimetres, even more preferably at least about 8 millimetres. In addition, or as an alternative, a length of the mouthpiece is preferably less than 25 millimetres, more preferably less than 20 millimetres, even more preferably less than 15 millimetres. In some preferred embodiments, a length of the mouthpiece is from about 4 millimetres to about 25 millimetres, more preferably from about 6 millimetres to about 20 millimetres. In an exemplary embodiment, a length of the mouthpiece is about 7 millimetres. In another exemplary embodiment, a length of the mouthpiece is about 12 millimetres.

In aerosol-generating articles in accordance with the present invention, a tubular support element is provided at a location between the rod and the mouthpiece segment. Further, an aerosol-generating article in accordance with the present invention comprises a recess defined by the tubular support element, wherein the recess is comprised between a downstream end surface of the rod and an upstream end surface of the tubular support element.

The tubular support element comprises a cylindrical peripheral wall and at least one airflow conduit extending longitudinally from an upstream end of the tubular support element to a downstream end of the tubular support element, such that the tubular support element establishes a fluid communication between the recess and the mouthpiece segment.

As explained briefly above, the tubular support element is longitudinal aligned with the rod and the mouthpiece segment and is arranged immediately downstream of the rod. This means that an upstream end surface of the peripheral wall directly contacts the downstream end surface of the rod of aerosol-generating substrate. Thus, the tubular support element may effectively maintain the rod of aerosol-generating substrate at a predetermined distance from the mouthpiece. In addition, the tubular support element imparts structural strength to the aerosol-generating article, such that it can easily be handled by the consumer and inserted into an aerosol-generating device for use.

At the same time, the tubular support element defines a downstream boundary of the recess and provides an elongate airflow passageway for the aerosol to form and flow towards the mouthpiece. Because of the recess, an inlet of the airflow conduit is effectively spaced from the downstream end of the rod.

During use, a thermal gradient is established along the airflow conduit of the tubular support element. In practice, a temperature differential is provided, such that a temperature of the volatilised aerosol components entering the tubular support element at the downstream end of the recess is greater than a temperature of the volatilised aerosol components exiting the tubular support element at the downstream end of the tubular support element (that is, right upstream of the mouthpiece). In general, it is desirable that a cumulative volume of the airflow conduit or conduits of the tubular support element is as large as possible, so as to favour the formation of aerosol and enhance the delivery of aerosol to the consumer.

A cumulative volume of the airflow conduit or conduits of the tubular support element is typically from about 2 percent to about 90 percent of the volume internally defined by the peripheral wall of the tubular support element. Preferably, a cumulative volume of the airflow conduit or conduits of the tubular support element is at least about 5 percent of the volume internally defined by the peripheral wall of the tubular support element. More preferably, a cumulative volume of the airflow conduit or conduits of the tubular support element is at least about 10 percent of the volume internally defined by the peripheral wall of the tubular support element.

In addition, or as an alternative, a cumulative volume of the airflow conduit or conduits of the tubular support element is preferably less than about 80 percent of the volume internally defined by the peripheral wall of the tubular support element. More preferably, a cumulative volume of the airflow conduit or conduits of the tubular support element is less than about 70 percent of the volume internally defined by the peripheral wall of the tubular support element. Even more preferably, a cumulative volume of the airflow conduit or conduits of the tubular support element is less than about 60 percent of the volume internally defined by the peripheral wall of the tubular support element.

In some preferred embodiments, a cumulative volume of the airflow conduit or conduits of the tubular support element is from about 5 percent to about 80 percent of the volume internally defined by the peripheral wall of the tubular support element.

In particular, as will become apparent from the following description of different embodiments of the tubular support element having various geometries and made of different materials, in some preferred embodiments, a portion of the material of the tubular support element projecting inwardly from a peripheral wall of the tubular support element only occupies from about 2 percent to about 25 percent of a cross-section of the cylindrical volume defined by the peripheral wall, more preferably from 5 percent to 15 percent of a cross-section of the cylindrical volume defined by the peripheral wall. Thus, the portion of the material of the tubular support element projecting inwardly from the peripheral wall advantageously contributes to imparting structural solidity to the tubular support element, whilst at the same time leaving a very significant portion of the cylindrical volume defined by the peripheral wall available for substantially unobstructed flow of the aerosol species during use.

In aerosol-generating articles in accordance with the present invention, the tubular support element may be formed of a porous material or of an air-impervious material. Suitable examples of porous materials include cellulose acetate as well as a number of other porous polymeric materials, which will be known to the skilled person. Suitable examples of air-impervious materials include non-porous polymeric materials, which will be known to the skilled person, with particular preference for bioplastics.

In more detail, different polymeric materials may be used depending on the manufacturing process by which the tubular support element is produced. By way of example, suitable manufacturing processes include extrusion, injection moulding, and 3D printing. In general, processes that enable the production of a component of a polymeric material with accurate control over size and shape and high reproducibility will be preferable.

The tubular support element extends from an outer surface of the cylindrical peripheral wall towards a longitudinal axis of the hollow tubular support element. In practice, a portion of the material of the tubular support element projects inwardly and is delimited at the upstream end of the tubular support element by at least one surface spaced from a transverse plane tangent to the most upstream end surface of the peripheral wall.

A thickness of the cylindrical peripheral wall will generally be from 0.2 millimetres to 5 millimetres. Preferably, a thickness of the cylindrical peripheral wall is less than 2 millimetres. More preferably, a thickness of the cylindrical peripheral wall is less than 1.5 millimetres. Even more preferably, a thickness of the cylindrical peripheral walls is less than 1 millimetre. In addition, or as an alternative, a thickness of the cylindrical peripheral wall is at least 0.2 millimetres. More preferably, a thickness of the cylindrical peripheral wall is at least 0.4 millimetres. Even more preferably, a thickness of the cylindrical peripheral wall is at least 0.6 millimetres.

Thus, at the upstream end, the cylindrical peripheral wall presents an end surface adapted to abut peripheral portion of the rod of aerosol-generating substrate.

In some embodiments, the upstream end surface of the peripheral wall has a substantially flat profile and contacts substantially in its entirety the downstream end surface of the rod. Thus, the downstream boundary of the recess is defined by an upstream end surface of a portion of the material of the tubular support element that projects inwardly from an inner surface of the peripheral wall. By way of example, the inwardly projecting portion of the material of the tubular support element may define one or more internal projections extending from the internal surface of the peripheral wall.

In alternative embodiments, the upstream end surface of the peripheral wall has a non-flat profile, for example a slanted profile or a curved profile, such that the peripheral wall contacts the rod only at its outermost peripheral edge, whereas some spacing is provided between the downstream end surface of the rod and the end surface of the peripheral wall at the inner periphery of the peripheral wall. In other words, the upstream end surface of the peripheral wall of the tubular support element also contributes to defining the downstream boundary of the recess, by defining a substantially frustoconical portion of the recess.

Preferably, a length of the hollow tubular element is at least about 10 millimetres. More preferably, a length of the hollow tubular element is at least about 15 millimetres. Even more preferably, a length of the hollow tubular element is at least about 20 millimetres. In addition, or as an alternative, a length of the hollow tubular element is preferably less than about 60 millimetres. More preferably, a length of the hollow tubular element is less than about 50 millimetres. Even more preferably, a length of the hollow tubular element is less than about 40 millimetres.

A length of the hollow tubular element will generally be from about 8 millimetres to about 60 millimetres.

In some preferred embodiments, a length of the hollow tubular element is from about 10 millimetres to about 60 millimetres, more preferably from about 15 millimetres to about 50, even more preferably from about 20 millimetres to about 40 millimetres. In some particularly preferred embodiments, a length of the hollow tubular element is from about 20 millimetres to about 30 millimetres. In a preferred embodiments a length of the hollow tubular element is about 26 millimetres.

As described above, the tubular support element comprises a cylindrical peripheral wall and a portion of material projecting inwardly from the cylindrical peripheral wall. In a cross-section of the tubular support element it is therefore possible to identify:

an annular portion, which corresponds to the cross-section of the cylindrical peripheral wall;

an internal occupied portion, which corresponds to the portion or portions of the cross-section of the circle internal to the annular portion wherein material of the inwardly projecting portion is found; and a void portion, which corresponds to the portion or portions of the cross-section of the circle internal to the annular portion wherein no material of the inwardly projecting portion is found.

By way of example, in a tubular support element comprising a cylindrical peripheral wall and two transverse walls orthogonal to one another, the internal occupied portion corresponds to the cross-section of the two transverse walls, and the void portion corresponds to the cross-section of the four identical circular sectors, each of which extends angularly substantially between two halves of the transverse orthogonal walls.

Thus, in a tubular support element as described above it is possible to measure or calculate the following parameters:

(a) a cumulative perimeter of the cross-section of the void portion—which may be calculated as the sum of the perimeters of each portion of the cross-section of the circle internal to the annular portion wherein no material of the inwardly projecting portion is found;

(b) a cumulative surface area of the cross-section of the void portion—which may be calculated as the sum of the surface areas of each portion of the cross-section of the circle internal to the annular portion wherein no material of the inwardly projecting portion is found;

(c) a surface area of the cross-section of the tubular support element—which may be calculated as the sum of parameter (b)+a surface area of the cross-section of the annular portion;

(d) a cumulative surface area of a peripheral surface of the void portion—which may be calculated as the sum of the surface areas of the surfaces delimiting the various portions of the void portion. For a tubular support element having a substantially constant cross-section, parameter (d) may be estimated as the product of the parameter (a) by an overall length of the tubular support element;

(e) a cumulative volume of the void portion—which may be calculated as the sum of the volumes of the various sub-portions of the void portion. For a tubular support element having a substantially constant cross-section, parameter (e) may be estimated as the product of the parameter (b) by an overall length of the tubular support element;

(f) an overall volume of the hollow tubular element—which may be calculated as the sum of parameter (e)+the volume of the annular portion+the volume of the internal occupied portion.

It will be understood that in a tubular support element of an article in accordance with the invention, the value of these parameters will generally be different if measured or calculated with reference to a cross-section at a location along the length of the recess or with reference to a cross-section at a location downstream of the recess.

In preferred embodiments, the ratio between parameters (a) and (c) is substantially equal to a ratio between parameters (d) and (f) when these parameters are measured or calculated with reference to a cross-section at a location downstream of the recess. Further, the ratio between parameters (a) and (c) is preferably at least about 0.1 $mm^{-1}$, more preferably at least about 0.2 $mm^{-1}$. In addition, or as an alternative, the ratio between parameters (a) and (c) is preferably less than about 10 $mm^{-1}$, more preferably less than about 5 $mm^{-1}$. In some particularly preferred embodiments, the ratio between parameters (a) and (c) is substantially equal to a ratio between parameters (d) and (f) and is from about 0.1 $mm^{-1}$ to about 10 $mm^{-1}$, more preferably from about 0.2 $mm^{-1}$ to about 5 $mm^{-1}$.

In preferred embodiments, the ratio between parameters (b) and (c) is substantially equal to a ratio between parameters (e) and (f) when these parameters are measured or calculated with reference to a cross-section at a location downstream of the recess. Further, the ratio between parameters (b) and (c) is preferably at least about 0.05, more preferably at least about 0.30, even more preferably at least about 0.40, most preferably at least about 0.50. In addition, or as an alternative, the ratio between parameters (b) and (c) is preferably less than about 0.99, more preferably less than about 0.95, even more preferably less than about 0.90, most preferably less than about 0.80. In some particularly preferred embodiments the ratio between parameters (b) and (c) is substantially equal to a ratio between parameters (e) and (f) and is from about 0.05 to about 0.99, more preferably from about 0.30 to about 0.95, even more preferably from about 0.40 to about 0.90, most preferably from about 0.50 to about 0.80.

The recess has a length of less than about 10 percent of an overall length of the aerosol-generating article. Preferably, the recess has a length of less than about 9 percent of an overall length of the aerosol-generating article. Even more preferably, the recess has a length of less than about 8 percent of an overall length of the aerosol-generating article.

In addition, or as an alternative, the recess preferably has a length of at least about 1 percent of an overall length of the aerosol-generating article. More preferably, the recess has a length of at least about 2 percent of an overall length of the aerosol-generating article. Even more preferably, the recess has a length of at least about 3 percent of an overall length of the aerosol-generating article. In some particularly preferred embodiments, the recess has a length of at least about 5 percent of an overall length of the aerosol-generating article.

In some especially preferred embodiments, the recess has a length from about 1 percent to about 10 percent of an overall length of the aerosol-generating article, preferably from about 2 percent to about 9 percent of an overall length of the aerosol-generating article, more preferably from about 5 percent to about 8 percent of an overall length of the aerosol-generating article.

In a preferred embodiment, the tubular support element has a length of about 26 millimetres and the recess has a length from about 5 percent to about 9 percent of the overall length of the tubular support element.

In some embodiments, a length of the recess is at least about 0.5 millimetres, more preferably at least about 0.75 millimetres, even more preferably at least about 1 millimetre. In addition, or as an alternative, a length of the recess is preferably less than about 5 millimetres, more preferably less than 3 millimetres, even more preferably less than 2 millimetres.

In particularly preferred embodiments, a length of the recess is from about 0.5 millimetres to about 3 millimetres, even more preferably from about 1 millimetre to about 2 millimetres.

In some embodiments, a cross-sectional area of the recess is substantially constant along the length of the recess.

In other embodiments, a cross sectional area of the recess changes along the length of the recess. Preferably, the recess tapers such that a cross-sectional area of the recess is greater at an upstream end of the recess than at a downstream end of the recess. Without wishing to be bound by theory, this is understood to be advantageous in that a profile of the recess may, to an extent, qualitatively match the temperature profile established within the aerosol-generating article during use. Thus, a distance between the downstream end surface of the rod and an upstream end surface of the tubular support element is greatest in the vicinity of the longitudinal axis of the aerosol-generating article where the highest temperature is expected to be reached. On the other hand, a smaller distance between the upstream end surface of the tubular support element and the rod at the periphery of the aerosol-generating article is expected to improve the stability of the rod and the overall structural strength of the aerosol-generating article.

As explained briefly above, in practice a portion of the material of the tubular support element projects inwardly towards the longitudinal axis.

In some embodiments, the tubular support element comprises one or more internal projections extending inwardly from the cylindrical peripheral wall, an upstream end surface of the one or more internal projections at least partly defining a downstream end boundary of the recess.

In alternative, preferred embodiments the tubular support element comprises at least one inner portion of material that extends from at least a first point on the inner surface of the cylindrical peripheral wall to at least a second point on inner surface of the cylindrical peripheral wall through a radial centre of the tubular support element, such that at least two airflow conduits extend longitudinally from the downstream end of the recess to the mouthpiece segment, each airflow conduit being defined between a surface of the at least one inner portion of material and the inner surface of the cylindrical peripheral wall.

More preferably, the inner portion of material comprises at least one wall extending across the volume internally defined by the cylindrical peripheral wall and through the longitudinal axis of the hollow tubular support element.

These embodiments are advantageous in that the internal transverse wall improves the structural strength of the tubular support element and, in turn, of the aerosol-generating article. Further, by presenting an elongate upstream end surface with a relatively low surface area, one such tubular support element is less likely to be damaged by the heat.

At the same time, these embodiments may provide well-defined airflow conduits having a predetermined cross-section, which enables an accurate and easy control of RTD. This is the case, in particular, for embodiments made of an air-impervious material.

An aerosol-generating article in accordance with the present invention preferably has an RTD of at least about 310 millimetres, Water Gauge (WG), more preferably at least about 320 millimetres WG, even more preferably 330 millimetres WG. In addition, or as an alternative, an aerosol-generating article in accordance with the present invention preferably has an RTD of less than about 390 millimetres WG, more preferably less than about 380 millimetres WG, even more preferably less than about 370 millimetres WG.

In preferred embodiments, an aerosol-generating article in accordance with the present invention preferably has an RTD from about 310 millimetres WG to about 390 millimetres WG, more preferably from about 320 millimetres WG to about 380 millimetres WG, even more preferably from about 330 millimetres WG to about 370 millimetres WG.

In a particularly preferred embodiment, the rod of aerosol-generating substrate has a length of about 14 millimetres and an RTD of about 350 millimetres WG.

Further, as will be explained in more detail below and in the Examples, they have high values of exposed surface area, which may favour cooling of the aerosol species flowing along the tubular support element.

Preferably, a ratio between an exposed surface area of the tubular support element and an internal volume of the tubular support element is at least 0.5.

As explained briefly above, the exposed surface area of the tubular support element may be calculated as the sum of the surface area of the inner surface of the peripheral wall and the surface area of other internal walls or projections of the tubular support member. In embodiments comprising at least one wall extending across the volume internally defined by the cylindrical peripheral wall and through the longitudinal axis of the hollow tubular support element, the surface area of the transverse internal wall may substantially be calculated as the product of the length of the transverse internal wall by the internal diameter of the tubular support element. For the purpose of calculating this ratio, the internal volume of the tubular support element is calculated as the volume internally defined by the peripheral wall without accounting for the volume occupied by the internal transverse wall or walls.

More preferably, a ratio between an exposed surface area of the tubular support element and an internal volume of the tubular support element is at least 0.6 $mm^{-1}$. Even more preferably, a ratio between an exposed surface area of the tubular support element and an internal volume of the tubular support element is at least 0.7 $mm^{-1}$. In particularly preferred embodiments, a ratio between an exposed surface area of the tubular support element and an internal volume of the tubular support element is at least 0.8 $mm^{-1}$. In some even more preferred embodiments, a ratio between an exposed surface area of the tubular support element and an internal volume of the tubular support element is at least 0.9 $mm^{-1}$, more preferably at least 1.0 $mm^{-1}$, even more preferably at least 1.1 $mm^{-1}$.

An overall length of the aerosol-generating article is preferably at least about 35 millimetres. More preferably, an overall length of the aerosol-generating article is at least about 40 millimetres. Even more preferably, an overall length of the aerosol-generating article is at least about 45 millimetres. In addition, or as an alternative, an overall length of the aerosol-generating article is preferably less than about 80 millimetres. More preferably, an overall length of the aerosol-generating article is less than about 75 millimetres. Even more preferably, an overall length of the aerosol-generating article is less than about 70 millimetres.

In preferred embodiments, an overall length of the aerosol-generating article is from about 35 millimetres to about 80 millimetres, more preferably from about 40 millimetres to about 75 millimetres, even more preferably from about 45 millimetres to about 70 millimetres.

Aerosol-generating articles as described above may be used in an electrically operated aerosol generating device as part of an aerosol-generating system in accordance with another aspect of the present invention. One such aerosol-generating system comprises an aerosol generating article as described above and an electrically operated aerosol generating device comprising a heating element and an elongate heating chamber configured to receive the aerosol generating article so that the rod of aerosol-generating substrate is heated in the heating chamber. Preferably, the heating element comprises a heater blade or a heater pin adapted to be inserted into the rod of aerosol-generating substrate when the aerosol generating article is received into the heating chamber.

The invention will now be further described with reference to the figures in which.

Figure 1:
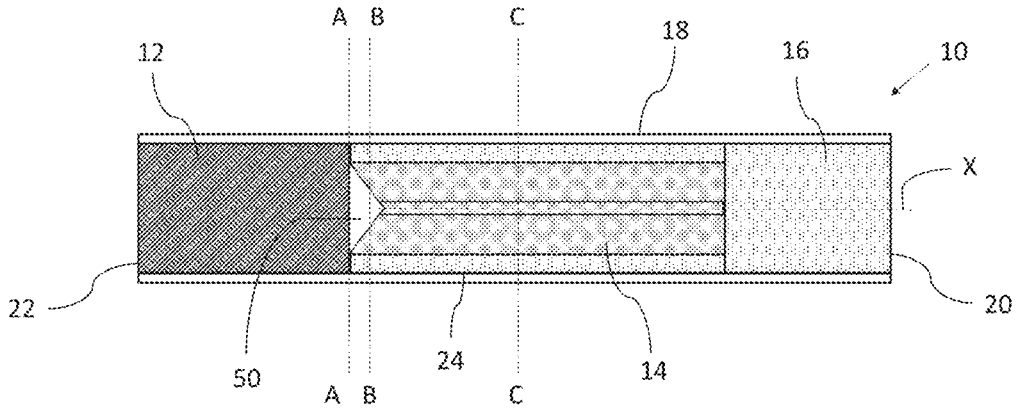
FIG. 1 shows a schematic side sectional view of an aerosol-generating article in accordance with a first embodiment of the invention, with the wrapper removed.
Figure 2:
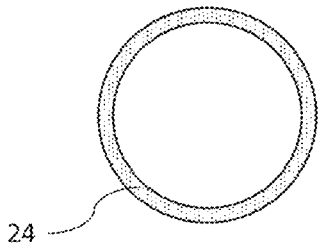
FIG. 2 shows a schematic cross-sectional view of the aerosol-generating article of FIG. 1 taken along the plane A-A.

The aerosol-generating article 10 shown in FIG. 1 comprises a rod of aerosol-generating substrate 12, a tubular support element 14, and a mouthpiece segment 16. These three elements are arranged sequentially and in coaxial alignment and are circumscribed by a wrapper 18 to form the aerosol-generating article 10. The aerosol-generating article 10 has a mouth end 20 and a distal end 22 located at the opposite end of the article to the mouth end 20. The aerosol-generating article 10 shown in FIG. 1 is particularly suitable for use with an electrically operated aerosol-generating device comprising a heater for heating the rod of aerosol-generating substrate.

The rod of aerosol-generating substrate 12 has a length of approximately 12 millimetres and a diameter of approximately 7.1 millimetres. The rod 12 is cylindrical in shape and has a substantially circular cross-section. The mouthpiece segment 16 also has a diameter of approximately 7.1 millimetres.

As shown in the Figures, the tubular support element 14, which has an outer diameter of approximately 7.1 millimetres, comprises a cylindrical peripheral wall 24 and extends from an outer surface of the cylindrical peripheral wall 24 towards a longitudinal axis X of the tubular support element 14. A length of the tubular support element 14 is about 30 millimetres.

Figure 3:
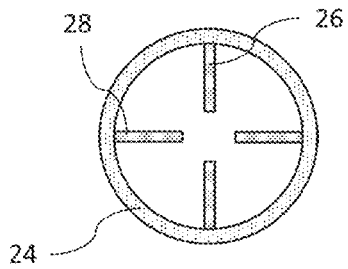
FIG. 3 shows a schematic cross-sectional view of the aerosol-generating article of FIG. 1 taken along the plane B-B.
Figure 4:
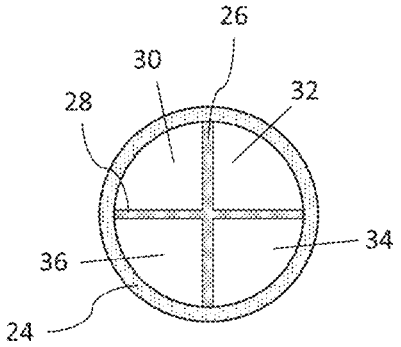
FIG. 4 shows a schematic cross-sectional view of the aerosol-generating article of FIG. 1 taken along the plane C-C.

Further, as illustrated more clearly in FIGS. 3 to 4, the tubular support element 14 comprises two inner portions of material 26, 28, each of which extends from at least a first point on the inner surface of the cylindrical peripheral wall 24 to at least a second point on the inner surface of the cylindrical peripheral wall 24 through a radial centre of the tubular support element 14. Thus, four airflow conduits 30, 32, 34, 36 extend longitudinally through the tubular support element 14, each airflow conduit being defined by surfaces of the inner portions of material 26, 28 and the inner surface of the cylindrical peripheral wall 24. In practice, each inner portion of material 26, 28 comprises a wall extending transversely across the volume internally defined by the cylindrical peripheral wall 24 and through the longitudinal axis X of the hollow tubular support element 14. By way of example, the airflow conduit 30 is delimited by a portion of the inner surface of the peripheral wall 24, a side surface of the transverse wall 26 and a side surface of the transverse wall 28.

A thickness of the cylindrical peripheral wall 24 is about 0.71 millimetres. Thus, at the upstream end, the cylindrical peripheral wall 24 presents a substantially flat, annular end surface adapted to contact and support a peripheral portion of the rod of aerosol-generating substrate 12. Further, a thickness of the transverse walls 26, 28 is about 0.16 millimetres.

Thus, in the cross-section of the tubular support element 14 the following can be identified:

an annular portion corresponding to the cross-section of the cylindrical peripheral wall 24;

an internal occupied portion corresponding to the cross-section of the two inner portions of material 26, 28; and a void portion corresponding to the cross-section of the four identical airflow conduits 30, 32, 34, 36. Thus, the following parameters may be calculated:

(a) a cumulative perimeter of the cross-section of the void portion=39 millimetres;

(b) a cumulative surface area of the cross-section of the void portion=23.5 square millimetres;

(c) a surface area of the cross-section of the tubular support element=39.6 square millimetres;

(d) a cumulative surface area of a peripheral surface of the void portion=1170 square millimetres;

(e) a cumulative volume of the void portion=705 cubic millimetres; and (f) an overall volume of the hollow tubular element=1188 cubic millimetres.

Thus, the ratio (a)/(c) substantially equals the ratio (d)/(f) and is about 0.98 $mm^{-1}$. Further, the ratio (b)/(c) substantially equals the ratio (e)/(f) and is about 60 percent.

As shown in FIG. 1, the aerosol-generating article 10 further comprises a recess 50 defined by the tubular support element 14, the recess 50 being comprised between a downstream end surface of the rod 12 and an upstream end surface of the tubular support element 14. The recess has a length of 1 millimetre. The airflow conduits 30, 32, 34, 36 extend longitudinally from a downstream end of the recess 50 to the mouthpiece segment 16.

In the embodiment illustrated in FIGS. 1 to 4, a cross-sectional area of the recess 50 changes along the length of the recess. In more detail, the recess 50 tapers, such that a cross-sectional area of the recess 50 is greater at an upstream end of the recess (at the plane A-A) than at a downstream end of the recess. FIG. 3 illustrates a cross-section of the aerosol-generating article at an intermediate location along the length of the recess 50 between the upstream end of the recess 50 and a downstream end of the recess 50, and shows how the tapered, upstream end surfaces of the transverse walls 26, 28 effectively define a downstream boundary surface of the recess 50.

Figure 5:
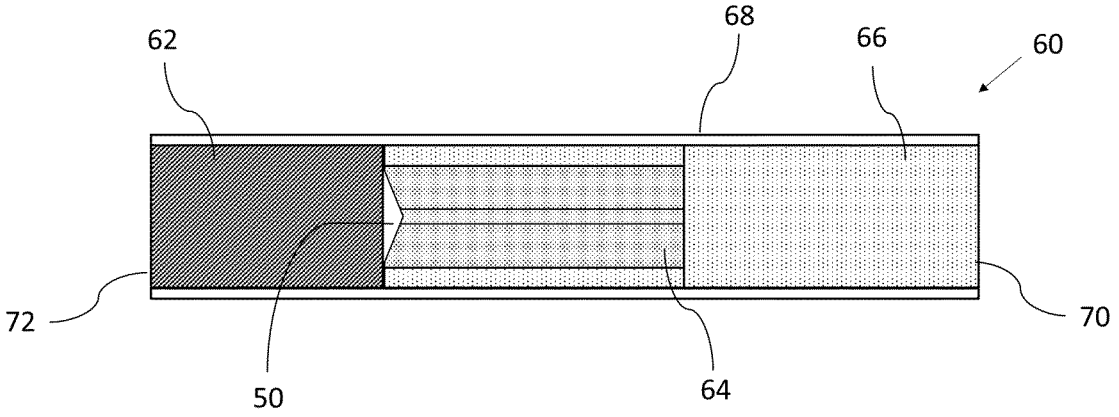
FIG. 5 shows a schematic side sectional view of an aerosol-generating substrate according to a second embodiment of the invention, with the wrapper removed.

FIG. 5 shows another embodiment of an aerosol-generating article 60 in accordance with the present invention. The aerosol-generating article 60 is similar to the aerosol-generating article 10 of FIG. 1 and will only be described below in so far as it differs from the aerosol-generating article 10.

The aerosol-generating article 60 comprises a rod of aerosol-generating substrate 62, a tubular support element 64, and a mouthpiece segment 66. These three elements are arranged sequentially and in coaxial alignment and are circumscribed by a wrapper 68 to form the aerosol-generating article 60. The aerosol-generating article 60 has a mouth end 70 and a distal end 72 located at the opposite end of the article to the mouth end 70. The rod of aerosol-generating substrate 62 has a length of approximately 12 millimetres and a diameter of approximately 7 millimetres. The rod 62 is cylindrical in shape and has a substantially circular cross-section. The aerosol-generating article 60 further comprises a recess 50 defined by the tubular support element 64, the recess 50 being comprised between a downstream end surface of the rod 62 and an upstream end surface of the tubular support element 64.

The tubular support element also has an outer diameter of approximately 7 millimetres and a length of about 15 millimetres. The mouthpiece segment 66 also has an outer diameter of approximately 7 millimetres and a length of about 18 millimetres.

Figure 6:
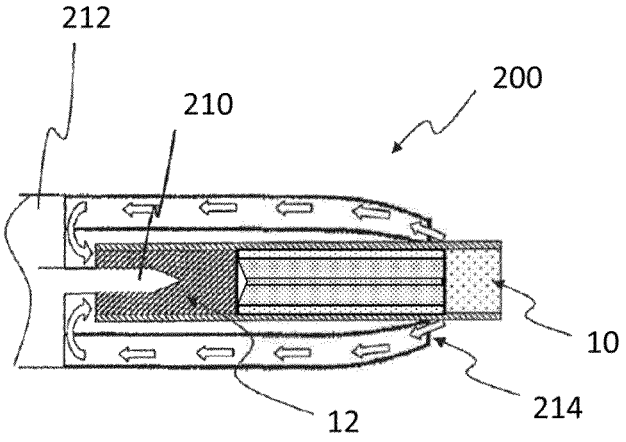
FIG. 6 shows a schematic longitudinal cross-sectional view of an aerosol-generating system comprising an electrically operated aerosol-generating device and the aerosol-generating article shown in FIG. 1.

FIG. 6 shows a portion of an electrically operated aerosol-generating system 200 that utilises a heater blade 210 to heat the rod of aerosol-generating substrate 12 of the aerosol-generating article 10 shown in FIG. 1. The heater blade 210 is mounted within an aerosol-generating article chamber within a housing of an electrically operated aerosol-generating device 212. The aerosol-generating device 212 defines a plurality of air holes 214 for allowing air to flow to the aerosol-generating article 10, as illustrated by the arrows in FIG. 6. The aerosol-generating device 212 comprises a power supply and electronics, which are not shown in FIG. 6.

The aerosol-generating article 10 shown in FIG. 1 is designed to engage with the aerosol-generating device 212 shown in FIG. 6 in order to be consumed.

The user inserts the aerosol-generating article 10 into the aerosol-generating device 212 so that the heater blade 210 is inserted into the rod of aerosol-generating substrate 12. The mouthpiece filter 16 projects outwards from the mouth end of the device 212. Once the aerosol-generating article 10 is engaged with the aerosol-generating device 212, the user draws on the mouth end 22 of the aerosol-generating article 10 and the rod of aerosol-generating substrate 12 is heated by the heater blade 210 to a temperature sufficient to generate an aerosol from the rod of aerosol-generating substrate 12. The aerosol is drawn through the mouth end filter 16 and into the user's mouth.

It will be appreciated that the aerosol-generating article 10 shown in FIG. 1 may also be suitable for use with other types of aerosol-generating devices.

The invention claimed is:

1. An aerosol-generating article for producing an inhalable aerosol upon heating, the aerosol-generating article comprising:

a rod of aerosol-generating substrate;

a mouthpiece segment comprising a plug of filtration material;

a tubular support element at a location between the rod and the mouthpiece segment, wherein the tubular support element is in longitudinal alignment with the rod and the mouthpiece segment, is arranged immediately downstream of the rod, and defines at least one airflow conduit establishing fluid communication between the rod and the mouthpiece segment, and wherein the tubular support element comprises a cylindrical peripheral wall, a portion of a material of the tubular support element projecting inwardly from the cylindrical peripheral wall; and a recess defined by the tubular support element, the recess being comprised between a downstream end surface of the rod and an upstream end surface of the tubular support element, the recess having a length of less than about 10 percent of an overall length of the aerosol-generating article, wherein the at least one airflow conduit extends longitudinally from a downstream end of the recess to the mouthpiece segment, and wherein a cross-sectional area of the recess changes along a length of the recess.

2. The aerosol-generating article according to claim 1, wherein the recess tapers, such that the cross-sectional area of the recess is greater at an upstream end of the recess than at the downstream end of the recess.

3. The aerosol-generating article according to claim 1, wherein a thickness of the cylindrical peripheral wall is less than 1 millimeter.

4. The aerosol-generating article according to claim 1, wherein the tubular support element comprises one or more internal projections extending inwardly from the cylindrical peripheral wall, an upstream end surface of the one or more internal projections defining a downstream end surface of the recess.

5. The aerosol-generating article according to claim 1, wherein the tubular support element comprises at least one inner portion of material that extends from at least a first point on an inner surface of the cylindrical peripheral wall to at least a second point on the inner surface of the cylindrical peripheral wall through a radial center of the tubular support element, such that at least two airflow conduits extend longitudinally from the downstream end of the recess to the mouthpiece segment, each airflow conduit being defined between a surface of the at least one inner portion of material and the inner surface of the cylindrical peripheral wall.

6. The aerosol-generating article according to claim 5, wherein the at least one inner portion of material comprises at least one wall extending across a volume internally defined by the cylindrical peripheral wall and through a longitudinal axis of the tubular support element.

7. The aerosol-generating article according to claim 6, wherein a thickness of the at least one wall is less than about 0.5 millimeters.

8. The aerosol-generating article according to claim 1, wherein a ratio between an exposed surface area of the tubular support element and an internal volume of the tubular support element is at least 0.6 $mm^{-1}$.

9. The aerosol-generating article according to claim 1, wherein the rod has a length of between about 7 millimeters and about 15 millimeters.

10. The aerosol-generating article according to claim 1, wherein the tubular element has a length of between about 10 millimeters and about 30 millimeters.

11. The aerosol-generating article according to claim 1, wherein an overall length of the aerosol-generating article is from about 40 millimeters to about 70 millimeters.

12. The aerosol-generating article according to claim 1, wherein the rod of aerosol-generating substrate comprises at least an aerosol former and has an aerosol former content of at least about 10 percent on a dry weight basis.

13. An aerosol-generating system, comprising:

an aerosol-generating article according to claim 1; and an electrically operated aerosol generating device comprising a heating element and an elongate heating chamber configured to receive the aerosol-generating article and to heat the rod of aerosol-generating substrate when the rod of aerosol-generating substrate is in the heating chamber.

14. The aerosol-generating system according to claim 13, wherein the heating element comprises a heater blade or a heater pin configured to be inserted into the rod of aerosol-generating substrate when the aerosol generating article is received in the heating chamber.

* * * * *